US005782384A

United States Patent [19]

Mejia Mustafa et al.

[11] Patent Number: 5,782,384

[45] Date of Patent: Jul. 21, 1998

[54] ALIGNED WEB IN A CONTAINER

[75] Inventors: Ramon Armando Mejia Mustafa, Hillsborough; Patrick Andre Connan, Lebanon, both of N.J.

[73] Assignee: Colgate-Palmolive, New York, N.Y.

[21] Appl. No.: 740,970

[22] Filed: Nov. 5, 1996

[51] Int. Cl.[6] ..... B65D 35/22

[52] U.S. Cl. ..... 222/94; 222/129; 493/212; 493/213; 493/920

[58] Field of Search ..... 222/94, 129; 493/87, 493/920, 906, 210, 211, 212, 213, 214, 297; 53/469, 474

[56] References Cited

U.S. PATENT DOCUMENTS

| | | | |
|---|---|---|---|
| D. 277,073 | 1/1985 | Czech . | |
| D. 306,554 | 3/1990 | Lawson . | |
| D. 307,113 | 4/1990 | Thompson . | |
| D. 311,861 | 11/1990 | Vanhoutte . | |
| D. 315,496 | 3/1991 | Pettengil . | |
| D. 356,026 | 3/1995 | Iaia et al. . | |
| 1,363,064 | 12/1920 | Stegath . | |
| 1,676,734 | 7/1928 | Hopkins . | |
| 1,828,865 | 10/1931 | Hopkins . | |
| 1,894,115 | 1/1933 | Murphy | 222/94 |
| 2,103,817 | 3/1937 | Johnson . | |
| 2,107,987 | 2/1938 | Johnson . | |
| 2,517,027 | 8/1950 | Rado . | |
| 2,661,871 | 12/1953 | Huenergardt . | |
| 2,939,610 | 6/1960 | Castelli . | |
| 2,944,705 | 7/1960 | Strumor . | |
| 2,959,327 | 11/1960 | Bloom . | |
| 3,105,615 | 10/1963 | Koga . | |
| 3,166,221 | 1/1965 | Neilsen . | |
| 3,182,728 | 5/1965 | Zabriskie . | |
| 3,197,071 | 7/1965 | Kuster . | |
| 3,227,319 | 1/1966 | Rosier . | |
| 3,365,111 | 1/1968 | McNair, Jr. et al. | 493/87 |
| 3,380,632 | 4/1968 | Wilson . | |
| 3,506,157 | 4/1970 | Dukess . | |
| 3,788,520 | 1/1974 | Dukess | 222/94 |
| 3,881,529 | 5/1975 | Mannara . | |
| 3,948,704 | 4/1976 | Evans . | |
| 3,980,222 | 9/1976 | Hood . | |
| 4,014,463 | 3/1977 | Hermann . | |
| 4,040,420 | 8/1977 | Speer . | |
| 4,046,288 | 9/1977 | Bergman . | |
| 4,089,437 | 5/1978 | Chutter . | |
| 4,099,651 | 7/1978 | Von Winckelmann . | |
| 4,148,417 | 4/1979 | Simmons . | |
| 4,211,341 | 7/1980 | Weyn . | |
| 4,260,077 | 4/1981 | Schroeder . | |
| 4,487,757 | 12/1984 | Kiozpeoplou . | |
| 4,528,180 | 7/1985 | Schaefer . | |
| 4,687,663 | 8/1987 | Schaeffer . | |

(List continued on next page.)

FOREIGN PATENT DOCUMENTS

| | | |
|---|---|---|
| 0 503 824 | 9/1992 | European Pat. Off. . |
| 0576222 | 6/1993 | European Pat. Off. . |
| 0 693 437 | 1/1996 | European Pat. Off. . |
| 3420324 | 1/1988 | Germany . |
| 43 35 970 | 4/1995 | Germany . |
| 29515380 | 1/1996 | Germany . |
| 2-205501 | 8/1990 | Japan . |
| 112375 | 12/1962 | Pakistan . |
| 2142611 | 1/1985 | United Kingdom . |
| WO 94/14680 | 7/1994 | WIPO . |

*Primary Examiner*—Kevin P. Shaver
*Assistant Examiner*—David Deal
*Attorney, Agent, or Firm*—Michael McGreal

[57] ABSTRACT

The web for a dual chamber tubular container can be maintained in an alignment across the container by providing one or more longitudinal modified areas on the web so that the web will yield and fold in the areas of the modified material. The modification will be a thinning or weakening of the web to produce yield points, such as fold points. This thinning or weakening can be produced mechanically or chemically. Mechanically, a pinch or other shaped roll can be used to thin or weaken an area. Thermally, heat can be applied. The result is a web that remains in an alignment across a tubular chamber rather than in close contact with the sidewall.

20 Claims, 2 Drawing Sheets

U.S. PATENT DOCUMENTS 4,742,940 5/1988 Wilkinson .
4,747,517 5/1988 Hart .
4,773,562 9/1988 Gueret .
4,819,789 4/1989 Linner .
4,964,539 10/1990 Mueller .
4,974,756 12/1990 Pearson .
4,981,241 1/1991 Keller .
5,020,694 6/1991 Pettengill .
5,038,963 8/1991 Pettengill .
5,045,305 9/1991 Clarkson .
5,076,464 12/1991 Simon .
5,078,963 1/1992 Mallen .
5,137,178 8/1992 Stokes .
5,145,668 9/1992 Chow .
5,209,376 5/1993 Dirksing .
5,224,627 7/1993 Weag .
5,244,120 9/1993 O'Meara ..... 222/94
5,269,441 12/1993 O'Meara .
5,289,949 3/1994 Gentile .
5,318,203 6/1994 Iaia et al. .
5,332,124 7/1994 Cancro .
5,335,827 8/1994 Gentile .
5,476,647 12/1995 Chow .

ALIGNED WEB IN A CONTAINER

FIELD OF THE INVENTION

This invention relates to a tubular chamber with an aligned web which divides the tubular chamber into a plurality of subsidiary chambers. This invention further relates to a method of aligning a web within a tubular chamber. Additionally, this invention relates to a tubular container comprised of a tubular chamber with an aligned web.

BACKGROUND OF THE INVENTION

Dual chamber tubular containers have been available for use for several decades. These are tubes that are generally circular or elliptical in shape and which have a web that divides the tubular container into two or more separate chambers. Usually these tubular containers are crimp sealed on the lower end in the same manner as conventional single chamber tubular containers and have one or more dispensing shoulders and nozzles attached to an upper end. The chamber forming web and the sidewalls are attached to this dispensing shoulder so that the chambers are separate from the crimp seal through the dispensing opening of the tubular container.

Usually in dual chamber tubular containers the chamber forming web will have a width greater than the major cross-sectional axis of the tubular container. For a circular tubular container this would be a width greater than the diameter of the tubular container. One reason for this need is that it is desired in many uses to crimp seal the tubular container with the web disposed linearly in the crimp seal. In this way this will be a three layer seal. If the web is not so disposed in the crimp seal then the web overlaps in areas with an uneven three to five layer crimp seal. Usually this will result in a weak crimp seal. When disposed in the crimp seal, the web will have to be about one half the circumference of the tubular container when the tubular container is of a round shape.

One problem with the web in such dual chamber tubular containers is that it tends to contact and follow the shape of the chamber sidewall. It does not stay disposed diametrically across the tube structure. This presents problems in making the tubular containers and in filling the tubular containers. The problem is that it can be difficult to attach the web to a dispensing shoulder and to put a filling head into each chamber in order to simultaneously fill the two chambers of the tubular container. When the web is contacting the tubular container sidewall, or in close proximity to the sidewall, it is difficult to manipulate the web. The present invention is directed to techniques for keeping the web positioned in a more diametric manner across the tubular container. The web is kept away from the container sidewalls.

The prior art of dual chamber containers is illustrated by U.S. Pat. No. 1,894,115; U.S. Pat. No. 3,506,157; U.S. Pat. No. 3,788,520 and U.S. Pat. No. 5,244,120. U.S. Pat. No. 1,894,115 discloses a dual chamber tube where the dividing web can be of a length greater than the diameter of the tube. However, the web as shown is not sufficiently wide to be within the crimp seal. To be within the crimp seal, the web would have to have a width of at least one half the circumference of the tube for a tube with a circular cross-section. U.S. Pat. No. 3,506,157 discloses a tube with two or three chambers. U.S. Pat. No. 3,788,520 discloses a tube with a web that has a corrugated-like fold. U.S. Pat. No. 5,244,120 discloses a dual chamber tube where the dividing web has a width greater than the diameter of the tube. However, this is not a sufficient length to be disposed in the crimp seal of the tubular container. These webs are not one half the circumference of the containers. In relation to the diameter d of the tube, the web should be ½ (πd). A web that has a length of at least ½ πd will have a sufficient width for dual tube construction.

BRIEF SUMMARY OF THE INVENTION

In dual chamber and other multiple chamber tubes the web dividing wall or walls, will in most instances, have a width dimension greater than or equal to the cross-sectional dimension of the tubular container. For a circular tubular container this will be a width dimension greater than the diameter of the tubular container. In most instances, the width of the web will be at least about one half the circumference of the tube. In mathematical terms this would be ½ π(d) where d is the diameter of the tube or about 1.57 (d). That is, the web should have a width of about one half again the diameter of the tubular container. A thin, flexible web having a width of 1.57 (d) or greater presents problems in a dual chamber tubular container. The web has a tendency to fall into contact with the inner surface of the sidewall. This can be due to the electrostatic attraction of the web for the sidewall or some other reason. The result, however, is that it is difficult to manipulate the web during the manufacture of the dual chamber tubular container and when filling the dual chamber tubular container. In the manufacture of the dual chamber tubular container, the web has to be manipulated when the dispensing end is attached. It has to be manipulated again when the tubular container is filled.

This problem of keeping a thin, flexible web aligned across the tubular container is solved by providing one or more longitudinal modified areas such as thinned or weakened areas to cause the thin, flexible web to have at least one fold point. Such a fold point can be at the center of the web or within about 80% of the of the distance of the center point of the web to the edge of the web at the sidewall. When there is such a fold point, the web material will gather more transversely across the tubular container rather than along the inner surface of a sidewall of the tubular container. Thus, at least one or more thinned or weakened modified areas can be an area of decreased thickness, or can be recess in the film that acts as a hinge or can be a treatment which makes the area more flexible. This area of decreased thickness can be from about a groove recess to about 50%, and preferably to about 25% of the width of the web. When a recess it will be about 0.1 mm to about 2 mm in width. The thickness of the thin, flexible web will be about 0.015 mm to about 0.2 mm.

The thinned or weakened modified areas can be created by running the web film through pinch rolls or other shaped rolls which splay the plastic to produce a thinned region. This can be from about 5% to about 50% of the thickness of the web. A wider thinned or weakened region will allow for a decreased thinning or weakening while a recess will need a greater thinning or weakening but at a more concentrated location. The thinned or weakened modified areas can also be created by heating, irradiation or a chemical treatment of the plastic surface to decrease the thickness or to otherwise affect the web material to selectively make it more flexible.

This creating a thinned area solves the problem of disposing the web across the tubular chamber and out of contact with the sidewalls of the tubular container. There is created a fold point so that the web is disposed more diametrically across the tubular chamber.

DETAILED DESCRIPTION OF THE INVENTION

Figure 1:
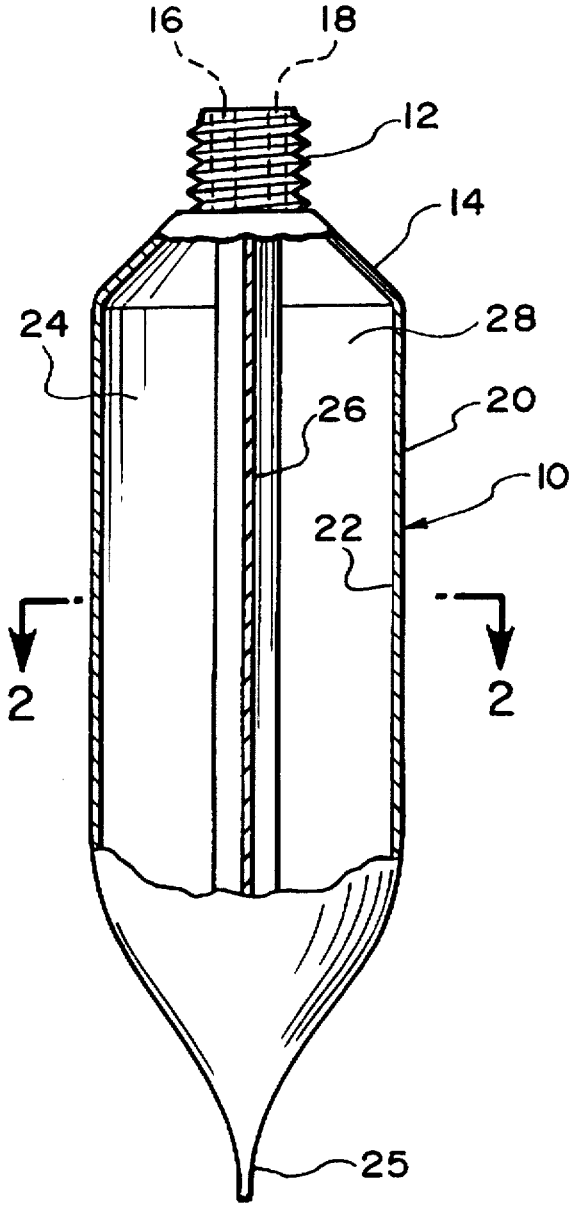
FIG. 1 is an elevational, sectional view of the present dual chamber tubular container with a web having a thinned area.

The present invention will be disclosed in more detail with reference to the drawings. In FIG. 1 there is shown a dual chamber tube 10 having a shoulder 14 and a dispensing end 12. The dispensing end carries apertures 16 and 18 for the dispensing of products from chambers 24 and 28 respectively. Web 26 separates the tubular container 10 into the two chambers formed by the web and sidewall 20. A crimp 25 seal the bottom of the tubular container. The web 26 is disposed in the crimp 25. This will keep the web disposed across the tubular container.

Figure 2:
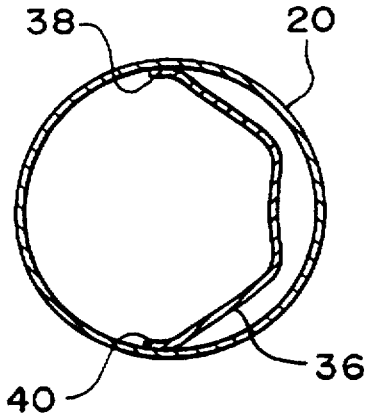
FIG. 2 is a cross-sectional view of the web of the tubular container with no thinned area.

FIG. 2 is a cross-sectional view of the tubular container of FIG. 1. Web 26 is attached to sidewall 20 at 32 and 34. The web has a thinned area at 30. This thinned area is essentially at a mid-point of the web. This is one preferred position. However, it is very effective if the modified thinned area is within about the central 80% of the lateral dimension of the web. That is, the thinned area is about ten percent of the distance from each of the sidewalls. This is shown as being between points of A and B in FIG. 2.

Figure 3:
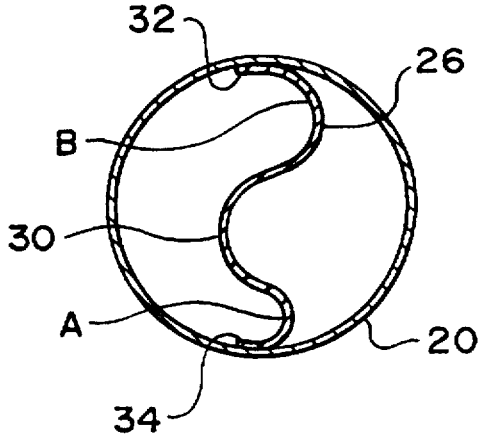
FIG. 3 is a cross-sectional view of the web of the tubular container with a thinned area.

FIG. 3 is a cross-sectional view of the web of the tubular container with no thinned area for the dispensing of products from chambers 24 and 28 respectively. Web 36 separates the tubular container 10 into the two chambers formed by the web 26 and sidewall 20. A crimp 25 seals the bottom of the tubular container. The web 26 is disposed in the crimp 25. The web is attached to the sidewall at 38 and 40. The web in this embodiment adjusts to a point adjacent to sidewall 20.

Figure 4:
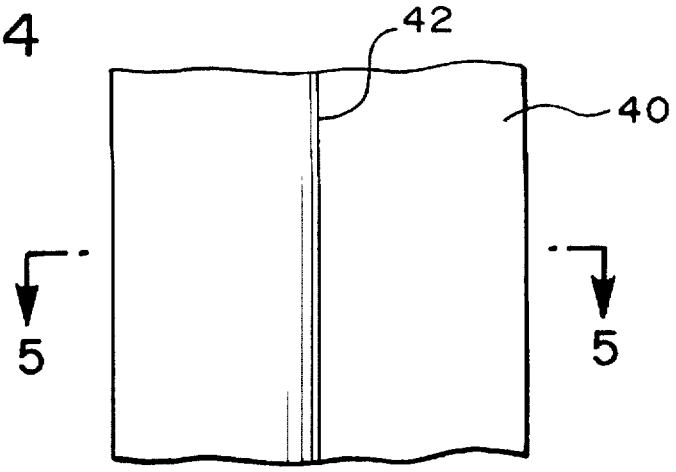
FIG. 4 is a cross-sectional view of a common position of a web having a constant thickness.
Figure 5:
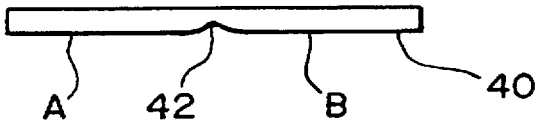
FIG. 5 is a cross-sectional view of the position of a web that has a centrally located recess thinned area.
Figure 6:
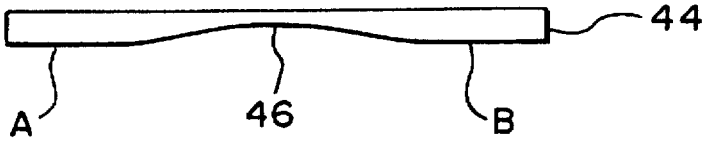
FIG. 6 is a cross-sectional view of a web with one wide thinned area.
Figure 7:
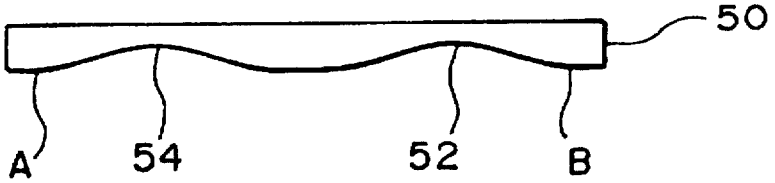
FIG. 7 is a cross-sectional view of a web with two thinned areas.

FIG. 4 is an elevational view of a web that has a recess 42 in one side. This is shown more clearly in FIG. 5. This area 42 is a narrow thinned area with this area 42 acting as a hinge around which the web 40 can bend. There can be more than one recess 42. FIG. 6 is a cross-sectional view of a web 44 where there is a thinned area 46 between points A and B. Points A and B are about one quarter of the distance in from the ends of the web 44. This thinned area is in contrast to the recess shown in FIG. 5. FIG. 7 shows two thinned areas 52 and 54 in web 50.

The weakening or thinning can be accomplished mechanically, thermally or chemically. It is preferred to accomplish the thinning or weakening mechanically. In this embodiment a pinch roll, or some other shaped roll, is passed in contact with the film at a pressure of about 1 $kg/cm^2$ to about 6 $kg/cm^2$. This force splays the plastic and produces a weakened area. This step can be a part of making the film where the weakened areas are formed just prior to the film being placed onto rolls. However, the film also can be mechanically modified just prior to the film being used. In this embodiment as the film is being unwound, one or more longitudinal weakened or thinned areas are produced. Thermally, heat can be provided to thin an area by flowing some of the plastic to another area. Chemically, some of the film surface can be leached away.

This invention is directed to the use of thin walled webs. These are thin flexible webs having a thickness of about 0.015 mm to 0.2 mm, and preferably from about 0.025 mm to 0.015 mm. The thinned area can be one or more recesses or thinned areas. This thinned area can be located at the center point of the web to any point to about 10% of the distance from the sidewall.

The web will be attached to the sidewalls by heat bonding, although adhesives would be used. The web material can be of essentially any plastic, with thermoplastics being preferred. These preferred plastics include polyethylene, polypropylene, copolymers of polyethylene and of polypropylene, ethylene vinyl alcohol, ethylene vinyl acetate, polyethylene terephthalate, polyvinyl chloride and polyvinylidine chloride.

What is claimed is:

1. A method of aligning a web in an elongated tubular chamber that is attached to the inner walls of said elongated tubular chamber comprising placing at least one longitudinal area of modified thickness along said web.

2. A method of aligning a web as in claim 1 wherein there are at least two longitudinal areas of modified thickness along said web.

3. A method as in claim 1 wherein said at least one area of modified thickness is located at about a midpoint of said web.

4. A method as in claim 3 wherein said at least one area of modified thickness is located from said midpoint of said web to a point about 10% of the distance to a sidewall of said tubular chamber.

5. A method as in claim 1 wherein said at least one area of modified thickeners is an area of decreased thickness.

6. A method as in claim 1 wherein said web has a thickness of about 0.015 mm to about 0.2 mm.

7. A method as in claim 1 wherein said sidewall has a thickness of about 0.25 mm to about 2 mm.

8. A method of aligning a web in an elongated tubular chamber comprising (a) providing a sidewall web and a partition web;

(b) placing an area of modified thickness longitudinally along said partition web;

(c) overlaying at least a part of said sidewall web with said partition and attaching the edges of said partition web to said sidewall web;

(d) overlaying the longitudinal edges of said sidewall web and attaching said longitudinal edges to form said elongated tubular chamber.

9. A method of aligning a web as in claim 8 wherein a dispensing shoulder is attached to one end of said partition web and said sidewall web of said elongated tubular chamber, said dispensing shoulder and said elongated tubular chamber forming two continuous separate chambers.

10. A method of aligning a web as in claim 9 wherein an other end of said elongated tubular chamber is sealed.

11. A method as in claim 8 wherein said at least one area of modified thickness is an area modified thickness is an area of decreased thickness.

12. An elongated tubular chamber with an aligned web comprising an elongated tubular chamber having an inner surface and open at each end, a web having two longitudinal edges within said elongated tubular chambers each of said longitudinal edges attached to the inner surface of said elongated tubular chamber, said web having at least one longitudinally extending area of modified thickness.

13. An elongated tubular chamber as in claim 12 wherein said at least one longitudinally extending area of modified thickness is at about a center point of said web.

14. An elongated tubular chamber as in claim 12 wherein said at least one longitudinally extending area of modified thickness is located from said midpoint to spaced about 10% of the distance to the inner surface of said elongated tubular chamber.

15. An elongated tubular chamber as in claim 12 wherein said elongated tubular chamber has a first end, said elongated tubular chamber being attached to a dispensing means at said first end, said dispensing means comprising one end having a shape complimentary to that of said one end of said elongated tubular chamber and said web whereby when said dispensing means is attached to said elongated tubular chamber, there are at least two separate chambers extending from said elongated tubular chamber through said dispensing means.

16. An elongated tubular chamber as in claim 12 wherein said at least one area of modified thickness is an area of decreased thickness.

17. A tubular container comprising an elongated tubular chamber closed at one end and having a dispensing opening at another end, said elongated tubular chamber having an inner surface and a web having two longitudinal edges within said elongated tubular chamber, each of said longitudinal edges attached to the inner surface of said elongated tubular chamber, said web having at least one longitudinally extending area of modified thickness.

18. A tubular container as in claim 17 wherein said at least one longitudinally extending area of modified thickness is from about the from the center point of said web to about 10 percent of the distance to the inner surface of said elongated tubular chamber.

19. A tubular container as in claim 17 wherein said area of modified thickness is an area of decreased thickness.

20. A tubular container as in claim 17 wherein there are up to three areas of modified thickness.

* * * * *